US010918144B2

(12) United States Patent
Ward

(10) Patent No.: US 10,918,144 B2
(45) Date of Patent: Feb. 16, 2021

(54) PATIENT GARMENT

(71) Applicant: Dignity Giving Suits (DGS) Limited, Chesterfield (GB)

(72) Inventor: Beverley Ward, Chesterfield (GB)

(73) Assignee: DIGNITY GIVING SUITS (DGS) LIMITED, Chesterfield (GB)

( * ) Notice: Subject to any disclaimer, the term of this patent is extended or adjusted under 35 U.S.C. 154(b) by 0 days.

(21) Appl. No.: 16/003,334

(22) Filed: Jun. 8, 2018

(65) Prior Publication Data

US 2019/0014837 A1 Jan. 17, 2019

Related U.S. Application Data

(63) Continuation of application No. 14/649,079, filed as application No. PCT/GB2013/000475 on Nov. 5, 2013, now abandoned.

(30) Foreign Application Priority Data

Dec. 4, 2012 (GB) ..... 1221825

(51) Int. Cl.
*A41D 13/12* (2006.01)

(52) U.S. Cl.
CPC ..... *A41D 13/1245* (2013.01); *A41D 13/129* (2013.01); *A41D 13/1236* (2013.01); *A41D 13/1254* (2013.01); *A41D 13/1263* (2013.01)

(58) Field of Classification Search
CPC ..... A41D 13/1245; A41D 13/1254; A41D 13/1263; A41D 13/129
USPC ..... 2/114
See application file for complete search history.

(56) References Cited

U.S. PATENT DOCUMENTS 884,063 A * 4/1908 Baldwin ..... A41D 13/04 2/51
1,284,391 A 11/1918 Luckett et al.
1,435,756 A 11/1922 Sweeney et al.
2,291,861 A 8/1942 Joseph et al.
2,520,026 A 8/1950 Beitchman et al.
2,661,472 A 12/1953 Miller et al.
2,701,364 A 2/1955 Palm et al.
(Continued)

FOREIGN PATENT DOCUMENTS

DE 202006017975 U1 3/2007
FR 2745689 A1 9/1997

OTHER PUBLICATIONS

DE 202006017975—English machine translation.
(Continued)

*Primary Examiner* — Anne M Kozak
(74) *Attorney, Agent, or Firm* — Oliff PLC

(57) ABSTRACT

A garment for health care use is disclosed. The garment comprises at least one rear panel, at least two front panels and a plurality of releasable seams, positioned along peripheral regions of said at least one rear panel and said at least two front panels for releasably connecting said at least two front panels to said at least one rear panel. Each of the at least two front panels is permanently connected to the at least one rear panel at least one position. At least a portion of one the front panels overlaps the other. The rear and front panels each comprise a plurality of flaps or regions which can be folded over when in use as worn by a wearer, to expose different areas of said wearer's body.

10 Claims, 7 Drawing Sheets

(56) References Cited

U.S. PATENT DOCUMENTS 2,923,009 A 2/1960 Helen et al.
3,141,175 A * 7/1964 Heater ..... A41D 15/005 2/74
3,246,342 A 4/1966 Pagano et al.
3,464,063 A * 9/1969 Hoegerman ..... A41D 13/1236 2/114
3,800,330 A 4/1974 Bowcut
4,031,566 A 6/1977 Johnson
4,422,186 A 12/1983 Loney
4,434,511 A 3/1984 Weiser
4,447,911 A 5/1984 Marcellaro
4,457,025 A 7/1984 Meryash
4,524,463 A * 6/1985 Ogden ..... A41F 9/025 2/105
4,578,825 A * 4/1986 Vote ..... A41D 13/1236 2/114
4,651,353 A 3/1987 Walden
4,759,083 A 7/1988 Belcher
4,914,756 A 4/1990 Grassick
4,964,173 A 10/1990 Gordon et al.
5,008,962 A 4/1991 Smith et al.
5,062,159 A 11/1991 Jakub
5,097,536 A * 3/1992 Cohen ..... A41D 13/1245 2/106
5,133,086 A 7/1992 Truitt et al.
5,222,258 A 6/1993 Mucci et al.
D336,968 S 7/1993 Russano
5,228,141 A * 7/1993 Remsky ..... A41D 13/1236 2/114
5,315,716 A 5/1994 Baum
5,440,763 A 8/1995 Shah et al.
5,535,450 A 7/1996 Melzer
5,553,323 A 9/1996 Chou et al.
5,603,123 A 2/1997 Chupa
D381,488 S 7/1997 Small
5,802,611 A 9/1998 McKenzie et al.
5,822,793 A 10/1998 Tokura et al.
5,903,922 A 5/1999 Vargason
D410,689 S 6/1999 Slokevage
5,926,851 A 7/1999 Kovalik
D412,388 S 8/1999 Paolacci
6,049,913 A 4/2000 Harrigan, Jr.
6,134,715 A * 10/2000 McLennan ..... A41D 13/1245 2/105
6,260,209 B1 7/2001 St. Ange
6,647,552 B1 11/2003 Hogan
6,694,521 B1 2/2004 Hopkins
6,792,622 B2 9/2004 Graves
7,000,261 B1 2/2006 Loffredo
7,073,204 B1 7/2006 Boyles
7,395,556 B2 7/2008 Eraca
D574,126 S 8/2008 McCray
7,418,742 B2 9/2008 Yoo
7,454,798 B2 11/2008 Feodoroff
D584,483 S 1/2009 Glynn
D622,935 S 9/2010 Jackson et al.
7,814,574 B2 10/2010 Gheneva
D636,558 S * 4/2011 Shelton ..... D2/720
7,966,672 B1 6/2011 Hagerman et al.
D657,530 S * 4/2012 Farris ..... D2/720
8,161,573 B1 4/2012 Burns-Cox
8,286,263 B2 10/2012 Sampson-Howlett
8,302,214 B2 11/2012 McGrath
8,359,666 B2 1/2013 Appel et al.
8,533,867 B2 9/2013 Oprandi et al.
8,713,715 B1 5/2014 Lewis
8,821,461 B2 * 9/2014 Kovensky ..... A41D 13/1281 2/104
8,826,466 B1 9/2014 Michaelis
8,832,864 B1 9/2014 Braden
D721,469 S 1/2015 Dye
D731,754 S 6/2015 Graham et al.
D738,591 S 9/2015 Criss
D739,120 S 9/2015 Young
9,125,440 B1 9/2015 Guerrero
D741,569 S 10/2015 Fredrickson
9,402,430 B2 * 8/2016 Jensen ..... A41D 1/22
9,491,975 B2 * 11/2016 Lintel ..... A41D 1/215
D796,781 S * 9/2017 Calucci ..... D2/720
2006/0272069 A1 12/2006 Sheetz
2008/0000006 A1 * 1/2008 Ochoa ..... A41D 13/1236 2/114
2009/0106872 A1 4/2009 Collins
2010/0050315 A1 * 3/2010 Christou-Kelly ..... A41D 13/1263 2/114
2010/0299803 A1 12/2010 Ladra
2012/0151658 A1 6/2012 Von Furstenberg et al.
2013/0276202 A1 * 10/2013 Forbes ..... A41D 13/1236 2/114

OTHER PUBLICATIONS

FR 2745689—English machine translation.
Notice of Allowance from United Kingdom Intellectual Property Office GB2503963 dated May 13, 2016.
Opinion Under Section 74A GB2503963 dated Dec. 22, 2015.
Affidavit of Susan Anne Neath in the matter of UK Patent No. GB2503963 Sep. 30, 2015.
Affidavit of Carol England in the matter of UK Patent No. GB2503963 Sep. 29, 2015.
International Search Report for PCT/GB2013/000475 dated Dec. 16, 2013.
Written Opinion of the International Searching Authority for PCT/GB2013/000475 dated Dec. 16, 2013.

* cited by examiner

PATIENT GARMENT

FIELD OF THE INVENTION

The present invention relates to a garment, particularly although not exclusively to a patient garment for use in health care.

BACKGROUND OF THE INVENTION

Conventional hospital gowns are provided for patients when in hospital, to use instead of the patient's normal clothes. There are several reasons for using hospital gowns including:

- Hospital gowns are more hygienic; the patient's own clothes may be dirty or contain bacteria.
- Hospital gowns in some cases are made of paper or thin plastic and can therefore be incinerated, reducing the transmission of disease and infection.
- Health care workers find that thin hospital gowns are convenient for listening to the heart and lungs of patients.
- Nurses giving injections to patients find it easier when the patient is wearing a gown rather than their normal clothing.
- Hospital gowns are thinner and looser than normal clothing, so patients are less likely to overheat.

There are several types of known hospital gown, including those for normal patient use, and those for special use including for example bariatric gowns and maternity gowns. Known hospital gowns include rear opening clinic gowns, and front opening kimono type gowns.

Referring to FIG. 1 herein, there is illustrated schematically in view from the front, an example of a known rear opening hospital gown. The gown comprises a single piece, having left and right sleeves, through which the arms can be fitted, and which is tied at the rear by one or more hook and loop (e.g., VELCRO®) type fastenings or one or more tie straps.

A problem with the known hospital gowns of the rear opening or smock type consisting of a sheet like section with two arms folded around the wearer from the front and tied at the rear near the spine, are that the gown must be removed almost entirely for any procedure to the front body area. Further, when worn, the gowns generally do not cover the patient's nether regions completely, and therefore leads to loss of dignity of the patient. This type of gown can leave part of the wearer's back and buttocks exposed.

Referring to FIG. 2 herein, there is illustrated schematically in view from the front, a known front opening clinic gown. The front opening gown is based on a kimono style, which is worn similarly to a coat or dressing gown, and which has two front flaps which cross over the body. A first front flap is secured by a tie strap near the right hip and a second front flap is secured by a second tie strip on the left hip, presenting externally. The gown is of a loose fitting and comfortable nature.

Known hospital gowns are made in a variety of colors and different fabrics and sizes for both female and male patients, and are used in hospitals, clinics, nursing homes and the like.

The specific embodiments presented herein aim to provide a garment which allows easy access to a patient's body areas without removal of the garment, and whilst at the same time being comfortable to use, and maintaining a patient's modesty and dignity. The specific embodiments presented herein aim to provide a more acceptable garment to a patient which is both comfortable and dignified for a patent and practical for health care workers and patient's alike.

SUMMARY OF THE INVENTION

According to a first aspect there of the present invention, there is provided a patient garment for health care use, said garment comprising:

at least one rear panel;

at least two front panels; and a plurality of releasable seams, positioned along peripheral regions of said at least one rear panel and said at least two front panels for releasably connecting said at least two front panels to said at least one rear panel; wherein each of the at least two front panels is permanently connected to the at least one rear panel at at least one position;

at least a portion of one the front panels overlaps the other; and said rear and front panels each comprise a plurality of flaps or regions which can be folded over when in use as worn by a wearer, to expose different areas of said wearer's body.

The garment according to this aspect can advantageously be worn front-to-back as expected for most situations, but also back-to-front when the wearer's ailment, or body part treatment, or some other condition, requires it.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

In the following description, drawings are shown of a garment, in which a user or wearer of the garment is not shown, so as not to obscure details of the garment itself. However, various features of the garments are described with reference to features of the human body of patient or wearer, as will be understood by the person skilled in the art. References to anatomical parts of a patient, wearer or user are to be understood to apply to the corresponding respective parts of the garment which lie adjacent those anatomical parts when the garment is being worn, for ease of understanding.

Figure 1:
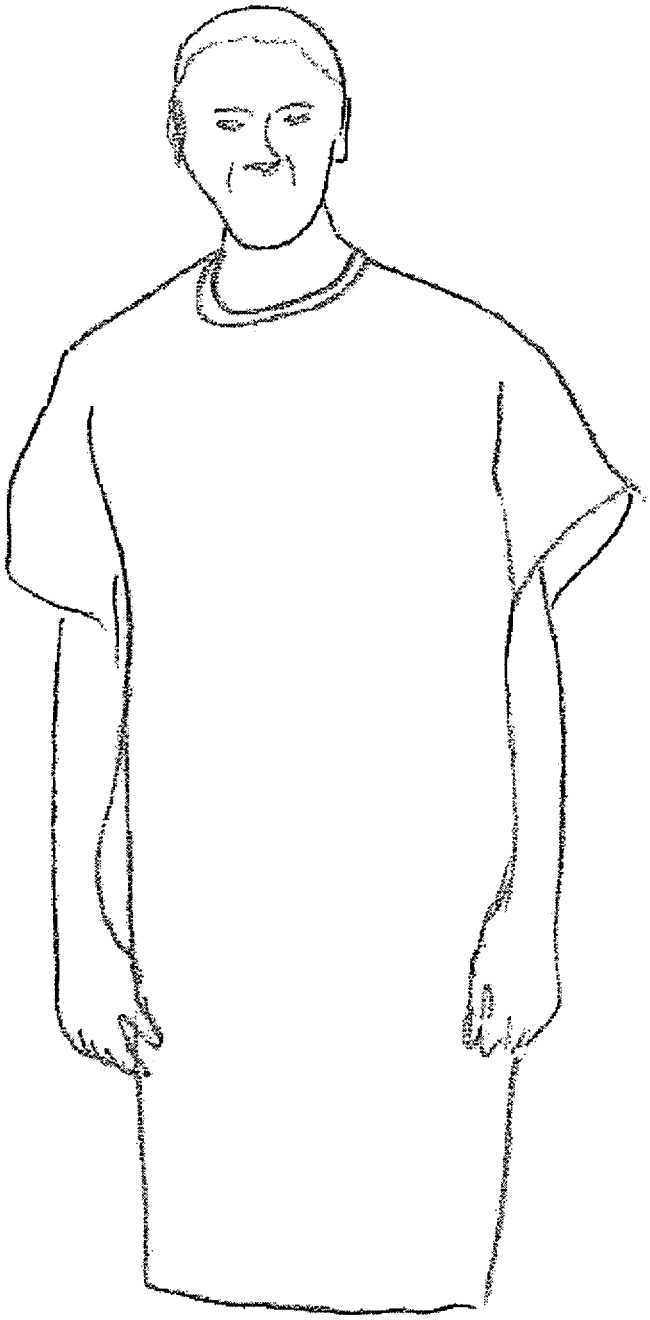
Fig.1 [PRIOR ART]
FIG. 1 illustrates schematically in perspective view, a known hospital gown of the rear opening type.
Figure 2:
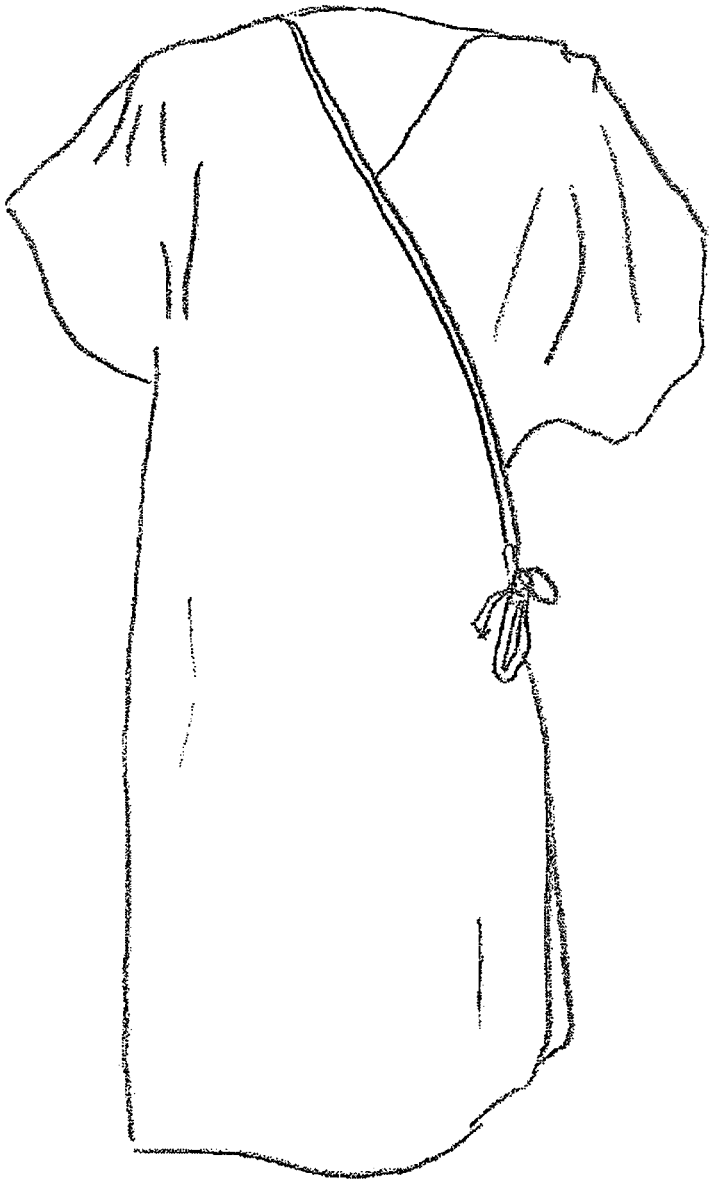
Fig.2 [PRIOR ART]
FIG. 2 illustrates schematically in perspective view, a known hospital gown of the front opening robe or kimono type.
Figure 3:
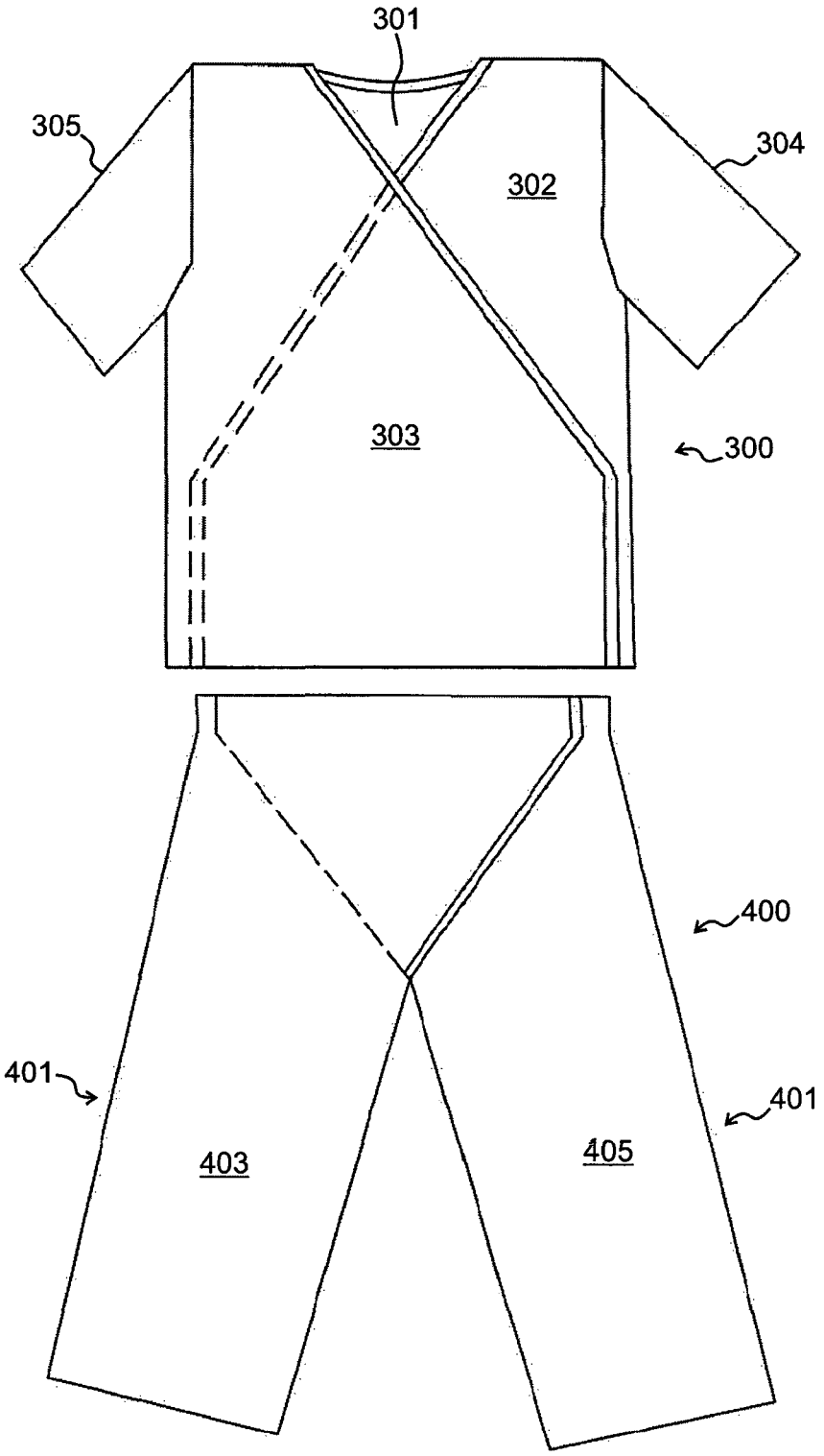
FIG. 3 illustrates schematically in perspective view, a patient garment according to a specific embodiment herein in view from the front.

Referring to FIG. 3 herein there is illustrated schematically in front view, a patient garment according to a first specific embodiment.

The patient garment comprises a top, shirt or jacket 300 (hereinafter referred to as a top), and a pair of trousers, pants or bottoms 400 (hereinafter referred to as bottoms).

The top comprises a rear panel 301 having an upper perimeter extending from the shoulders and the nape of the neck, to a lower perimeter near the wearer's waist; a left front panel 302 extending from the wearer's left side, under their left arm, across the body to the wearer's right hip and diagonally across the chest; a right panel 303 extending across the wearer's body from the wearer's right shoulder, and right underarm, across the body to the wearer's left side at a position under the left arm and near the left hip; a left sleeve 304 connected to the rear panel and the left front panel; and a right sleeve 305 joined to a right hand side of the rear panel and to the front right panel.

It will be understood by the person skilled in the art that the top 300 can also be produced in the opposite sense, that is, wherein the left front panel overlaps the right front panel, in an alternative embodiment.

In visual appearance, the top 300 resembles a short sleeved kimono style shirt.

The front left portion and the rear portion are preferably permanently connected to each other at a position underneath the left sleeve, and similarly, the front right panel and the right portion of the rear panel are preferably connected to each other at a position underneath the right sleeve. This allows the three main panels of the top to remain connected to each other for laundry, and avoids having the front left and rear panels of different tops becoming mixed up with each other. Also, if the garment is to be incinerated, then all three garments of the panel can remain attached to each other to be taken away for incineration.

In other embodiments, the front right panel and/or front left panel may be completely detachable from each other and from the rear panel.

Figure 4:
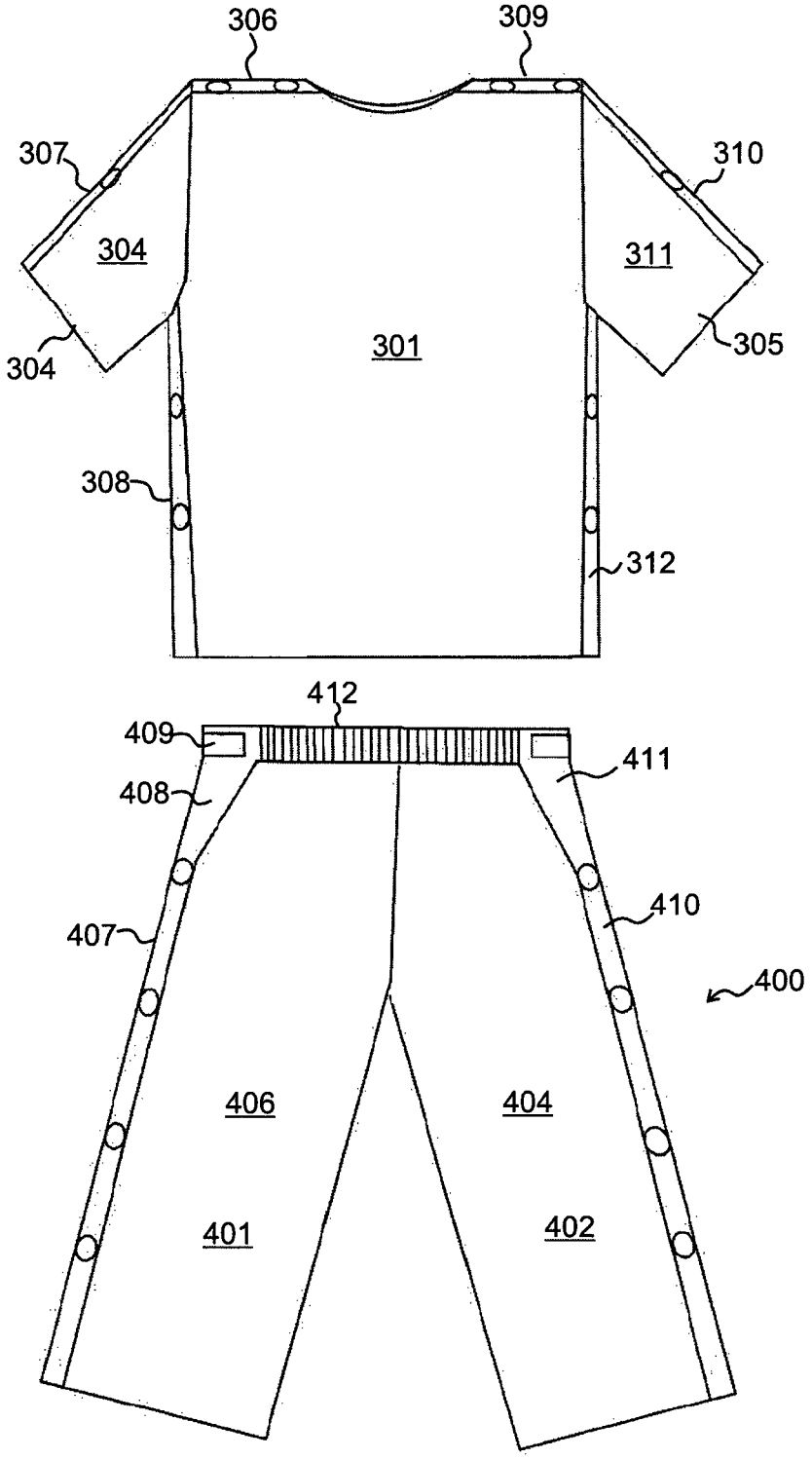
FIG. 4 illustrates schematically in perspective view, the embodiment patient garment in view from the rear.

As shown in FIG. 4 herein, for the top, the peripheral regions of the front left panel 302 are detachably connected to peripheral regions of the rear panel 301 by separable or detachable seams. Similarly, peripheral regions ofthe right front panel 303 are detachably connected to other peripheral regions of the rear panel 301, so that the top has detachable seams allowing health care workers easy access to the side of the chest, the area around the neck and clavicle, the left arm and the right arm, and to the patient's shoulder and back area, by detaching the corresponding seams. Individual seams can be detached without the need to detach other seams, to allow easy access for examination and treatment of the patient's upper body.

Referring to FIG. 4 herein for the top 300, an upper left shoulder part of the left front panel is attached at an upper left shoulder end of the rear panel 301 by a left shoulder seam 306, and the sleeve portion of the left front panel is attached to the rear left sleeve portion 304 of the rear panel by a left sleeve seam 307. A left underarm seam 308 connects a left peripheral portion of the rear panel 301 to a left peripheral region of the left front panel 302.

Similarly, a right shoulder seam 309 connects an upper edge of the right front panel 303 to an upper edge of the rear panel 301 on the right hand side of the wearer, and a right sleeve seam 310 connects a front panel of the right sleeve 305 to a sleeve panel 311 of the rear panel 301. A right hand edge of the rear panel 301 is connected to a right hand edge of the right front panel, by a right under arm seam 312.

All seams are easily separable and re-attachable using the patient's or a hospital workers thumbs and fingers, and without excessive force or excessive movement, which may disturb an injured patient who may be in pain.

Each seam comprises a near edge peripheral region of a first panel, for example the rear panel, which has a first attachment means, for example part of a hook and eye fastening such as a hook and loop (e.g., VELCRO®) fastening, or buttons, or a button hole, and a near edge peripheral region of the other panel, for example a front panel, which has a corresponding opposite attachment means, such as an opposite sense hook and loop (e.g., VELCRO®) strip or an opposite button hole or button. In the best mode, the seams are attached by hook and loop (e.g., VELCRO®) pads attached on either side of the seam.

Referring to FIGS. 3 and 4 herein, the bottoms or trousers 400 comprise a left leg 401 and a right leg 402. The right leg comprises a front panel 403 extending from a position between the wearer's front center line and the wearer's left hip, and from the left hip, across the wearer's groin and extending down the wearer's right leg, and a rear panel 404 extending from a center line on the wearer's rear buttocks, and from the wearer's hip, down the rear of the right leg, towards the wearer's ankle.

The left leg 401 comprises a front panel 405 extending from the wearer's right hip, and from the wearer's waist line at a position between the wearer's front center line and the wearer's right hip down to the wearer's left ankle and extending across a front of the wearer's left leg; and a rear left panel 406 extending from a center line down the wearer's body covering the left buttock and extending down the rear of the left leg.

A detachable and re-attachable left hand seam 407 connects a left edge of the left front panel 405 to a left edge of the left rear panel 406. The left front panel 405 comprises, at its upper left edge, an extending waist tab 408, having a hook and loop (e.g., VELCRO®) type strip 409, for attaching the upper edge of the left front panel to a left upper corner of the left rear panel 406, to form a continuation waist band between the rear panel and the front left panel.

Similarly, the right front panel 403 has a right hand edge at which is positioned a right hand seam 410 extending from the wearer's waist, down to the bottom of the right leg, and which is detachable and re-attachable. At the upper right hand corner of the right front panel 403, there is positioned a right waist tab 411, which overlaps with a right hand upper corner of the rear panel, and attaches therewith by means of hook and loop (e.g., VELCRO®) or like fastening means, to form a continuation of a waist band around the wearer's waist. In the center of the rear panel at the upper end, there is an elasticated waist strip 412.

The rear panel of the trousers, at its upper edge, an elasticated waist band 412, so that the trousers, whilst being comfortable, can be worn without the need for a belt, and without accidentally falling down.

For the trousers, the rear panel is preferably permanently connected to the front left leg panel at the crotch position and down the inside left leg, and similarly, the front right leg panel is connected to the rear panel at the crotch region and down the inside right left.

Figure 5:
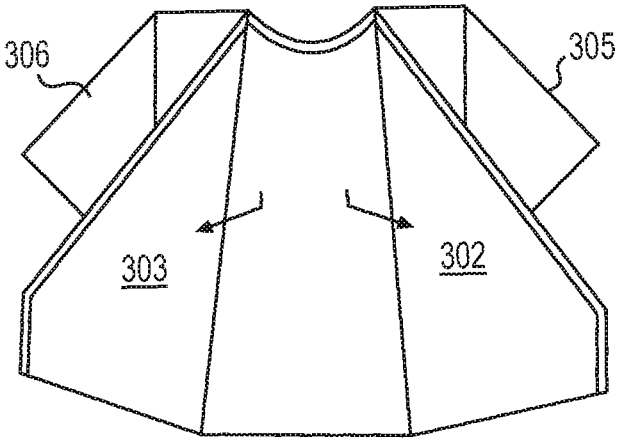
FIG. 5 illustrates schematically in perspective view, a jacket, shirt or top of the patient garment of FIG. 3 herein in a first opened up configuration in view from the front.

Referring to FIG. 5 herein, there is illustrated schematically in the top in opened out view. As shown in FIG. 5, the top can be opened out when worn, by swinging the right front panel 303 across the wearer's body, and swinging the left front panel 302 across the wearer's body to expose the stomach and chest, as with a conventional kimono type garment.

Figure 6:
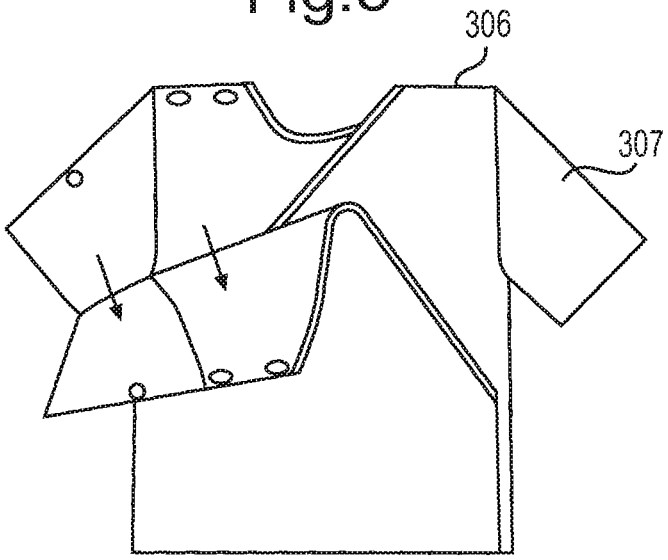
FIG. 6 illustrates schematically in perspective view, a jacket, shirt or top of the patient garment of FIG. 3 herein in a second opened up configuration as viewed from the front.

Referring to FIG. 6 herein, there is illustrated schematically in view from the front, the top 300, opened to give access to the wearer's right shoulder and right upper arm. The upper seam 309 of the front right panel, and the upper seam 310 of the right sleeve detach from the corresponding respective upper edge regions of the right hand side of the back panel, folding downwards to allow access to the wearer's right shoulder, right collar bone, the right hand side of the neck, and the upper portion of the wearer's right arm.

Similarly, the upper portion of the left front panel 302 may also be detached at the left shoulder seam 306 and left seam sleeve 307 to expose the left clavicle, the left shoulder and upper arm, and the patient's left neck.

Figure 7:
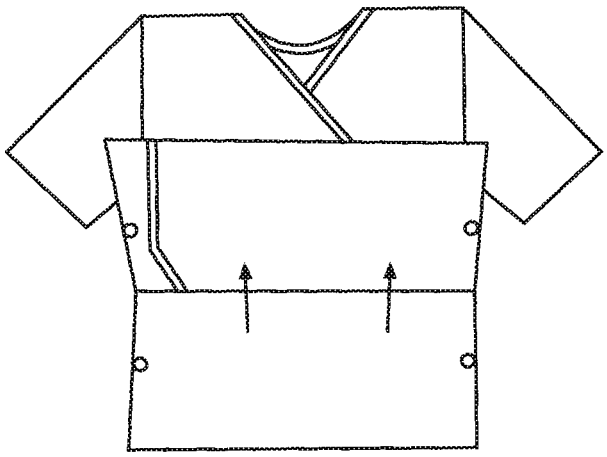
FIG. 7 illustrates schematically in perspective view, a jacket, shirt or top of the patient garment of FIG. 3 herein in a third opened up configuration as viewed from the front.

Referring to FIG. 7 herein, there is illustrated schematically the top 300 opened up to allow access to the hip and abdominal region of a patient wearing the top. The lower part of the right seam 312 of the right front panel can be detached from the lower part of the right hand seam of the rear panel, and similarly, the left hand seam 308 of the left front panel can be detached from the corresponding left hand seam of the rear panel, so that both the front and rear panels can be folded upwardly across a line substantially across the wearer's body, to expose the wearer's abdomen and hip area.

Figure 8:
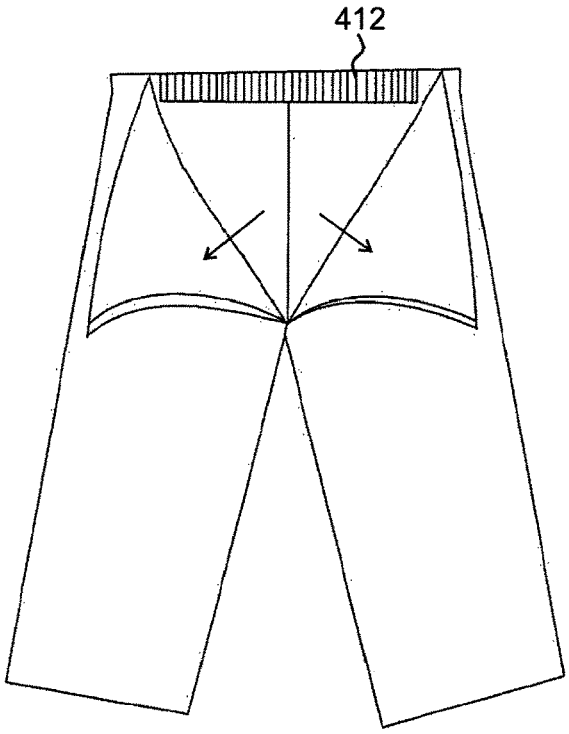
FIG. 8 illustrates schematically in perspective view, a pair of trousers, pants or bottoms comprising the patient garment of FIG. 3 in a first opened up configuration as viewed from the front.

Referring to FIG. 8 herein, there is illustrated schematically the trousers, pants or bottoms 400, showing access to the groin region of the wearer. An upper substantially triangular portion of the right front panel can be folded over forwardly or outwardly across a line extending from the crotch to a position adjacent the wearer's right hip. Similarly, an upper portion of the left front panel can be folded outwardly, about a second line extending substantially from the wearer's crotch adjacent the wearer's left hip, so that with both panels folded outwardly, the wearer's groin region is exposed.

Figure 9:
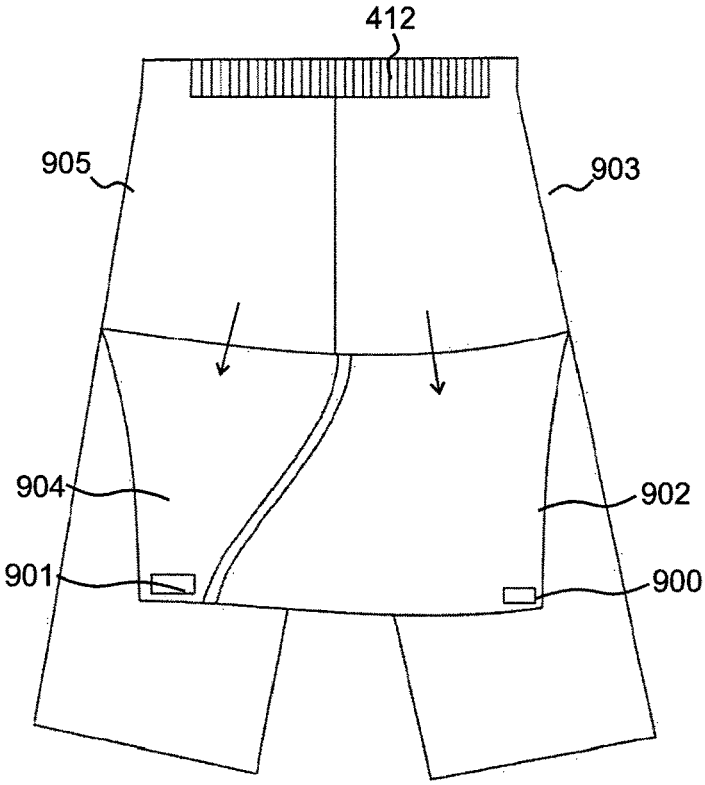
FIG. 9 illustrates schematically in perspective view, a pair of trousers, pants or bottoms comprising the patient garment of FIG. 3 in a second opened up configuration as viewed from the front.

Referring to FIG. 9 herein, there is illustrated schematically in view from the front, the bottoms 400 in a second opened out configuration to expose the wearer's hip and groin area. In this configuration, the wearer may either be standing up, or (more likely) lying in the supine position on a bed or table. The upper portions of both the front left leg panel and front right leg panel are detached from the corresponding respective rear left and right leg panels by separating the external side seams, allowing the upper parts of the two front panels to fold downwardly along a fold line substantially across the top of the wearer's legs. As shown in FIG. 9, there are first and second hook and eye hook and loop (e.g., VELCRO®) type attachment pads 900, 901 on each of the respective left and right front panels which attach to corresponding hook and loop (e.g., VELCRO®) pads on the waist portion of the rear panel. An outer seam of the left front panel is detached from a corresponding outer seam of the left rear panel. Similarly, an outer seam of the right front panel detaches from an outer seam at the right hand side of the rear panel, by detaching the hook and loop (e.g., VELCRO®) or other like fastenings from each other. After examination or treatment, the panel can simply be folded over the wearer's lower abdomen, hip and groin area, and the left and right seams 902, 903, 904 and 905 being reconnected manually.

Figure 10:
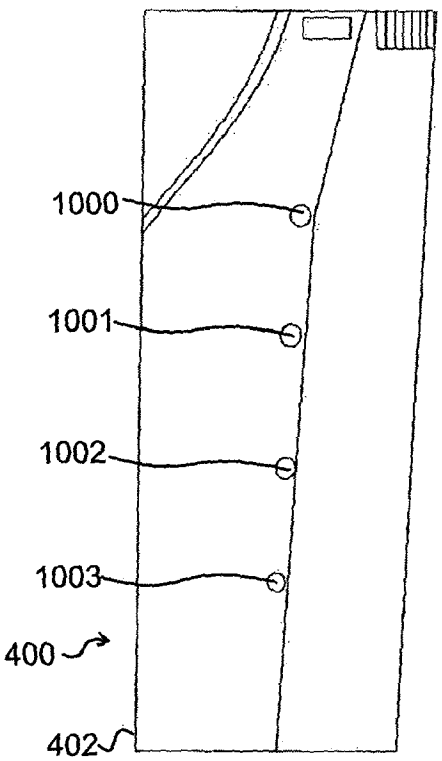
FIG. 10 illustrates schematically in perspective view, a pair of trousers, pants or bottoms comprising the patient garment of FIG. 3 in view from the left hand side.

Referring to FIG. 10 herein, there is illustrated schematically in view from the left hand side, the bottoms 400. As shown in view from the side, the rear left panel 406 extends from the wearer's ankle up to their waist, and is connected to the left front panel 405 of the trousers. An upper portion of the right front panel 403 is shown connected adjacent the wearer's waist on the left hand side of their body. An outer seam 407 extending from the wearer's hip down to the wearer's ankle connects the left rear portion 404 and the left right panel 403 using one or a plurality of fasteners 1000, 1001, 1002 and 1003 which can be detached or re-attached easily by a nurse's or other medical practitioner's hands.

Ideally, separable seams are fastened by a type of fastener which can be easily manipulated without the need for excessive manual pressure or forcing, which may disturb the patient, for example with an injury. Typically, hook and loop (e.g., VELCRO®), buttons, plastic press studs, zip fastenings or similar fastenings may be employed. In some embodiments, metal press studs or buttons may be employed, however preferably the material used for the fastenings would be non-metallic, so as not to show up on or interfere with x-ray procedures.

Figure 11:
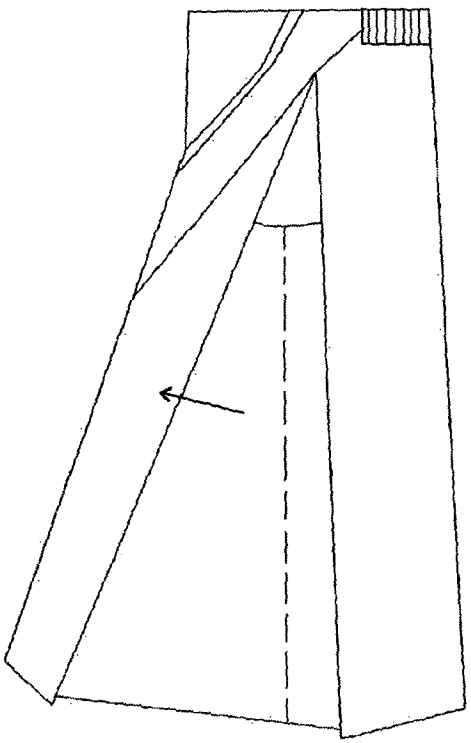
FIG. 11 illustrates schematically in perspective view, a pair of trousers, pants or bottoms comprising the patient garment of FIG. 3 in a third opened up configuration as viewed from the left hand side.

Referring to FIG. 11 herein, there is illustrated schematically in view from the left hand side, the trousers or bottoms 400, with the upright separable seam 407 between the outer portion of the left front panel and the outside of the left rear panel separated, but retaining the attachment of the upper part of the left front panel with the upper part of the left rear panel, so as to form a continuous waist band around the wearer's waist. As shown, this exposes substantially all of the wearer's left leg from the hip downwards, by folding the front left panel forward. Similarly, although not shown in FIG. 11, the left rear panel can also be folded away from the wearer's leg in order to give access to the side and rear of the wearer's left leg.

Similarly, the outer seam of the right hand leg may be detached to allow inspection of the right leg.

Figure 12:
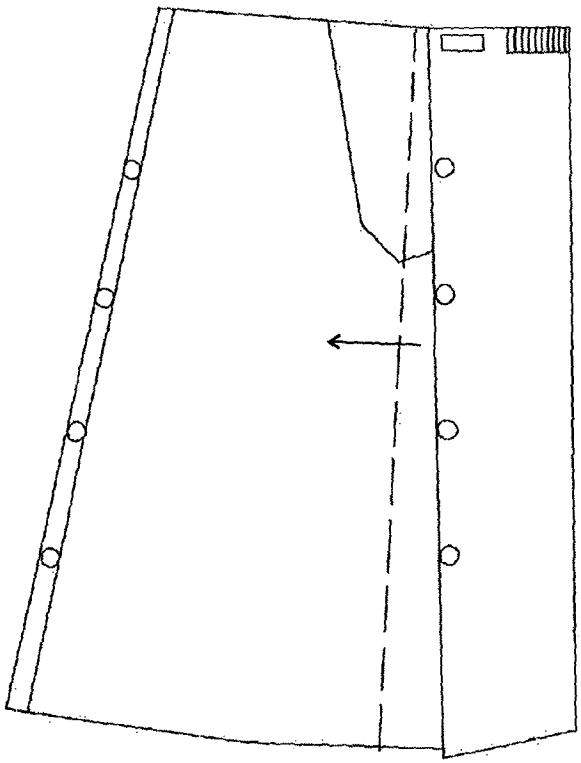
FIG. 12 illustrates schematically in perspective view, a pair of trousers, pants or bottoms comprising the patient garment of FIG. 3 in a fourth opened up configuration as viewed from the left hand side.

Referring to FIG. 12 herein there is illustrated schematically opening of the left leg of the trousers, for inspection of the whole of the wearer's left leg (leg not shown in FIG. 12). In this configuration, the seam extending along the outside of the left leg is fully detached so that the seam on the outside of the left front panel is fully detached from the outer seam on the leg portion of the back rear panel. This allows the left front panel to be fully folded forward exposing the front portion of the wearer's left leg, and similarly, the left portion of the back panel can be also folded backwards, to expose the rear of the wearer's left leg, and the rear part of the wearer's buttock.

The right hand side of the trousers opens out similarly as the left hand side as shown in FIGS. 11 and 12.

Preferably The three main panels of the trousers remain connected to each other at the crotch position, so that if the trousers are sent for laundry, different left and right portions of different garments do not get mixed up with each other. This avoids panels from different sizes of garments being mixed up with each other, as well as providing for traceability for infection control. Also, the three panels of the garment remain attached to each other when the garment is sent for destruction/incineration.

In other embodiments of the bottoms 400, the back panel front left panel and front right panel may be completely detachable from each other and from the rear panel.

The invention claimed is:

1. A garment for health care use, the garment comprising:

at least three panels including at least one rear panel adapted for extending across a wearer's back; and at least two front panels, wherein a first of the at least two front panels is adapted for extending across a wearer's body from the wearer's left hand side to the wearer's right hip region and a second of the at least two front panels is adapted for extending across the body from the wearer's right hand side to the wearer's left hip region;

a plurality of detachable seams, positioned along peripheral regions of each of the at least one rear panel and the at least two front panels detachably connecting the at least two front panels to the at least one rear panel, the plurality of detachable seams including a right underarm seam and a left underarm seam; wherein, the right underarm seam detachably connects a right hand underarm region of the second of the at least two front panels to a right hand underarm region of the at least one rear panel, and the left underarm seam detachably connects a left hand underarm region of the first of the at least two front panels to a corresponding left hand underarm region of the at least one rear panel, and each of the at least two front panels is permanently connected to the at least one rear panel at an under-arm position above the right underarm seam and the left underarm seam;

at least a portion of one of the at least two front panels overlaps another of the at least two front panels; and the at least one rear panel and the at least two front panels each comprise a plurality of flaps and regions adapted to be folded over when in use to expose different areas of the wearer's body.

2. The garment as claimed in claim 1, wherein each detachable seam comprises a first seam area positioned at a peripheral region of one of the at least one rear panel and the at least two front panels; and a second seam area positioned at a peripheral region of another of the at least one rear panel and the at least two front panels, wherein the first and second seam areas are attachable to each other and detachable from each other.

3. The garment as claimed in claim 1, wherein the first of the at least two front panels is adapted to extend from the wearer's left shoulder across a central portion of the body to the wearer's right hip.

4. The garment as claimed in claim 1, wherein the second of the at least two front panels is adapted to extend from a position on the right shoulder of the wearer, across the wearer's body to a position adjacent the wearer's left hip.

5. The garment as claimed in claim 1, comprising a shirt, or top, or jacket.

6. The garment according to claim 1, wherein each of the detachable seams comprises a hook and loop fastening.

7. A garment for health care use, the garment comprising:

at least three panels including at least one rear panel adapted for extending across a wearer's back; and at least two front panels, wherein a first of the at least two front panels is adapted for extending across a wearer's body from the wearer's left hand side rightward beyond a midline of the wearer's body, and a second of the at least two front panels is adapted for extending across the body from the wearer's right hand side leftward beyond the midline of the wearer's body;

a plurality of detachable seams, positioned along peripheral regions of each of the at least one rear panel and the at least two front panels detachably connecting the at least two front panels to the at least one rear panel, the plurality of detachable seams including a right underarm seam and a left underarm seam; wherein, the right underarm seam detachably connects a right hand underarm region of the second of the at least two front panels to a right hand underarm region of the at least one rear panel, and the left underarm seam detachably connects a left hand underarm region of the first of the at least two front panels to a corresponding left hand underarm region of the at least one rear panel, and each of the at least two front panels is permanently connected to the at least one rear panel at an under-arm position above the right underarm seam and the left underarm seam;

at least a portion of one of the at least two front panels overlaps another of the at least two front panels; and the at least one rear panel and the at least two front panels each comprise a plurality of flaps and regions adapted to be folded over when in use to expose different areas of the wearer's body.

8. The garment as claimed in claim 7, wherein each detachable seam comprises a first seam area positioned at a peripheral region of one of the at least one rear panel and the at least two front panels; and a second seam area positioned at a peripheral region of another of the at least one rear panel and the at least two front panels, wherein the first and second seam areas are attachable to each other and detachable from each other.

9. The garment as claimed in claim 7, comprising a shirt, or top, or jacket.

10. The garment according to claim 7, wherein each of the detachable seams comprises a hook and loop fastening.

* * * * *